US006464569B1

(12) United States Patent
Thierer

(10) Patent No.: US 6,464,569 B1
(45) Date of Patent: Oct. 15, 2002

(54) DEVICE FOR WORKING A SURFACE, ESPECIALLY A LIFTING PLATFORM, AND A METHOD FOR OPERATING SUCH A DEVICE

(75) Inventor: Georg Thierer, Bad Schoenborn (DE)

(73) Assignee: Liftlux Potain GmbH, Dillingen/Saar (DE)

( * ) Notice: Subject to any disclaimer, the term of this patent is extended or adjusted under 35 U.S.C. 154(b) by 0 days.

(21) Appl. No.: 09/623,362

(22) PCT Filed: Mar. 2, 1999

(86) PCT No.: PCT/EP99/01344

§ 371 (c)(1),
(2), (4) Date: Sep. 1, 2000

(87) PCT Pub. No.: WO99/44788

PCT Pub. Date: Sep. 10, 1999

(30) Foreign Application Priority Data

Mar. 3, 1998 (DE) ..... 198 08 691

(51) Int. Cl.[7] ..... B24C 3/06
(52) U.S. Cl. ..... 451/92; 451/38

(58) Field of Search ..... 451/92, 75, 87, 451/88, 91, 38

(56) References Cited

U.S. PATENT DOCUMENTS 4,286,417 A 9/1981 Shelton

FOREIGN PATENT DOCUMENTS

| | | | |
|---|---|---|---|
| DE | 9319642 | U | 10/1993 |
| EP | 0511636 | A | 11/1992 |
| EP | 0665085 | A | 8/1995 |
| WO | 8303071 | A | 9/1983 |

*Primary Examiner*—Robert A. Rose
(74) *Attorney, Agent, or Firm*—Roylance, Abrams, Berdo & Goodman, L.L.P.

(57) ABSTRACT

A device for working a surface, especially a lifting platform, includes boom or a platform, a working means, which can be placed against the surface to be worked, and a means which is arranged between the boom or the platform and the working means and which provides an application force that acts on the working means. The working means is suspended on a suspension such that it can move freely around two axes, which preferably form a right angle. The means which provides the application force engages with the suspension.

20 Claims, 4 Drawing Sheets

DEVICE FOR WORKING A SURFACE, ESPECIALLY A LIFTING PLATFORM, AND A METHOD FOR OPERATING SUCH A DEVICE

FIELD OF THE INVENTION

The present invention relates to a lifting device and to a method of operating that lifting device. More specifically, the lifting device has a support and a working means mounted on the support for treating a surface. A pressure mechanism is arranged between the support and the working means and provides a contact and engaging force on the working means.

BACKGROUND OF THE INVENTION

U.S. Pat. No. 4,286,417 discloses a device with a movable boom for supporting the device as it treats a surface. A device for cleaning the surfaces of objects having extensive surface areas with a movable blasting jet basket or cage is disclosed in DE 36 29 623 C2. In this case, one of more jet nozzles of a sand blasting apparatus, as disclosed in AT E 151 678 T1, are located in the blasting jet basket or cage for dust-free application of the blasting on surfaces.

EP 0 511 636 A1 discloses a device for positioning and guiding a tool, for example a cleaning tool for the aircraft. The alignment of the working means is performed by sensor-controlled stepping motors mounted on pivotal support arms articulated with one another. A similar arrangement of support arms, arranged one behind the other and articulated together and pivotally powered by a motor is disclosed in WO 83/03071.

EP 0 665 085 A1 discloses a device for working a surface in which the working means is engaged by magnetic force on the surface to be worked. The permanent magnets applying the magnetic force in this case are arranged on a support device for the working means.

DE 93 10 642 U1 discloses a surface blasting device having two removal suction openings offset from one another arranged in the working basket or cage. Within the working basket or cage baffle are found.

The lift platform includes an undercarriage which is customarily power-driven. An upper carrying chassis, rotatable around a perpendicular axis, is mounted on the undercarriage. On the upper carrying chassis, an overhand beam can pivot around a horizontal axis. The overhand beam is telescopically extensible, and its end more distant from the upper carrying chassis has a working means, a work platform or a working basket or cage, for example a blasting jet basket or cage.

The device can also incorporate, for example, a shearing device platform or a stamp, ram or piston platform. Its end adjacent to the surface to be worked supports a platform corresponding to the end of the overhang beam carrying the working means. In this embodiment, the device is preferably mounted on a movable undercarriage, especially on a movable undercarriage having a completely insertable steering control with an articulation angle of at least 90°, preferably on both sides or in both directions. Thus, by moving the platform during the overhead blasting procedure, the working means is brought into contact with the surface to be worked, while the forward thrust and the parallel displacement are carried out essentially by displacement of the platform. The engagement attained by displacement or positioning of the platform occurs during the blasting to the side, whereas the forward thrust can be executed especially by lifting and lowering of the platform. The working of the surface in terms of parallel movement in turn is performed especially by moving the platform forward. A multiply-articulated overhang beam can come into consideration as another alternative to the lifting platform, which multiply-articulated overhang beam customarily provides redundant spatial coverage by its mechanical means involving a number of articulations.

For certain purposes, for example involving the use of the lifting platform as the blasting tool itself, the working means is engaged directly on the surface to be worked. Prom the point of view of industrial safety, and for ecological and economical reasons, the working means must have the capacity to be engaged on the surface to be worked in such a manner that it engages the surface within a peripheral seal. For this purpose for example single-or double-row brush seals, a vacuum seal or a seal supported by magnetic force, as known from DE 29 04 093 A1, come into consideration.

In the case of a known lifting platform, the working means is engaged or pressed onto the surface to be worked through a pivot moment of the upper carrying chassis. The chassis is pivotal around the perpendicular axis relative to the undercarriage, or by means of sensor-controlled, multiple-axle drive systems engaging directly on the working means. This arrangement incorporates the drawback that either the contact and engagement force is not precisely adjustable and controllable because the total mass and bulk weight of the upper carrying chassis, the overhang beam and the working basket or cage must all be pivoted by the pivot movement, or the sensor-controlled drive systems are susceptible to interference in the area of the working means. Neither the required sealing between working means and surface to be worked nor the required service life of the lifting platform is guaranteed. Therefore, with the known lifting platform, the operational procedures on sensitive surfaces, such as for example for cleaning or application of varnish or paint to aircraft surfaces, cannot be carried out.

SUMMARY OF THE INVENTION

Objects of the present invention are to provide a device for the working of a surface, especially a lifting platform, which platform also has a long service life and provides an adjustable contact and engagement force controlled with a high degree of constancy.

Objects of the present invention also include a method for the operation of such a lifting platform. The method is to guarantee particularly the covering of a predeterminable path on a surface having high maintenance requirements, wherein the working means is in constant contact with the surface to be worked.

The foregoing objects are attained through a lifting device for treating a work surface comprising a support and a working means for engaging the work surface mounted on the support. Pressure means, arranged between the support and the working means, provides a contact and engagement force on the working means. A suspension suspends the working means to more freely about two angularly oriented axes. The pressure means engages the suspension.

The foregoing objects are also obtained by a method of operating a lifting device, comprising the steps of contacting and engaging a working means on a surface to be treated by a pressure means arranged between the working means and a support on which the working means is mounted, displacing said working means along a predetermined path, and compensating for modifications of distances between the working means and the surface to be treated resulting from displacement of the working means along the predetermined path by a suspension engaging the pressure means and suspending the working means to move freely about two angularly oriented axes.

By the working means being suspended on the suspension arrangement, it is universally movable and can move freely about two axes forming preferably a right angle. Additionally, the means for supplying the contact and engagement force engages on the suspension arrangement, without any need for multiple-axle, sensor-controlled and breakdown-susceptible drive devices. Thus, a secure contact of the working means with the surface to be worked is guaranteed. The contact and engagement of the working means on the surface to be worked is executed by means of an independent single-axle control and regulation, and particularly with continuous force.

The suspension is preferably in the form of a fork-like suspension arrangement for the bell—or basket-shaped working means. The shaft of the fork-like suspension is suspended universally rotatable around its longitudinal axis, for example by means of a tapered or conical roller bearing. With suitable arrangement of terminal switches on the two driven axes of the suspension arrangement, when a predetermined pivot angle of the working means relative to the fork or to the axis of the tapered or conical roller bearing is attained, the working means can be pivoted by means of corresponding drive means back into its starting position. Thus, for example, the position of the working means can serve as a starting position in which a beneficial guiding of the supply tubes and conduits to the working means, for example to a blasting or spray tool, is allowed. Also, position detectors can be arranged on both axes of the suspension device, especially angle detectors, which transmit to a control unit a response message regarding the positions of the two axes and with that, information regarding the alignment of the working means in relation to the surface to be worked. Thus, it can be guaranteed that the contact and engagement force engaging on the suspension arrangement works essentially only in one direction, which forms a right angle with the surface to be worked. The surface clamped by the fork of the suspension device is preferably parallel to the surface to be worked or forms an acute angle of 0 to 30° with this surface.

A pneumatic or hydraulic cylinder, or a spring with a comparatively low spring stiffliess or force constant adapted to a specific work range or some similar arrangement can be considered as means for supplying the contact and engagement force. A hydraulic cylinder is operable alone or in cooperation with a hydraulic accumulator. Preferably it is operable with a constant and relatively low pressure. With use of a pneumatic cylinder, the accumulator effect can be attained particularly simply on the basis of the compressibility of the working medium. The distance modifications occurring during operation of the working means along a predeterminable path on the surface to be worked are compensated or equalized by means of raising the means for providing the contact and engagement force, especially the means in the form of the pneumatic cylinder. Several position switches can be arranged along the lifting path, especially at the end positions as well as in a central position. Instead of or alternatively to the position switches, which realize discrete position detection, a continuous position detection of the lifting position of the accumulator can also be provided.

The working means or the suspension device carrying the working means can be controlled in its rotation around two perpendiculars axes by a first driving means relative to the end of the working means adjacent to the overhang beam. Particularly, a first drive element of the first driving means rotates the suspension device around a first vertical axis and a second drive element of the first driving means rotates the suspension device around a first horizontal axis. Beyond that, the first drive element can additionally be configured to be rotatable around another horizontal axis by a third drive element of the first driving means. The first driving means serve for the follow-up or resetting—hereinafter to be referred to exclusively as resetting—of the means for supplying the contact and engagement force and are controlled from the position information coming from the means for providing the contact and engagement force. As a result of the pivot capacity of the working means in relation to the overhang beam, both the side working and the overhead working of the surface is possible. In turn, modifications of the distance between the working means and the surface to be worked are compensated or equalized by the means for providing the contact and engagement force.

Beyond that provision, the resetting of the means for supplying the contact and engagement force and with that the working means of the suspension device is thus executed by means of second driving means. The second driving means drive an overhang beam which can be displaced in and out telescopically, which in relation to the upper carrying chassis can be rotated around a second horizontal axis, and drive the upper carrying chassis in relation to a substructure or foundation, especially an undercarriage, rotatably around a second vertical axis.

The second driving means are thus at least partially controllable by the position information coming from the means for providing the contact and engagement force. Thus, for example, more or less simultaneously with the side blasting, by control of the in and out displacement of the overhang beam and of the rotation of the overhang beam around the second horizontal axis in relation to the upper carrying chassis, a path predeterminable by means of a control device can be covered on the surface to be worked. If, because of a curvature of the surface to be worked, the distance between the working means on the end of the overhang beam and the surface to be worked is so great that the distance can no longer be compensated by the means for providing the contact and engagement force, and with corresponding position information being transmitted from these means to the control device, for example, as a result of the operation of a terminal position switch, then the overhang beam is reset by rotation of the upper carrying chassis in relation to the substructure in the direction toward the surface to be worked, thereby equalizing the distance differential.

In a corresponding manner, in terms of the overhead blasting, a resetting can be executed by rotation of the overhang beam around the second horizontal axis, when the predetermined path has been covered by means of control of the in and out displacement of the overhang beam and by rotation of the upper carrying chassis in relation to the substructure. The displacements originating from the second driving means are thus detected by sensors, is especially, the resetting displacement is used as input variable for control of the displacement of the working means along the predetermined path, in order, for example, to be able by the resetting displacement to undertake certain control corrections and/or in order to hold the path velocity constant during the working of the surface.

Both the first and second driving means can particularly include double-acting pneumatic or hydraulic cylinders.

Such devices, insofar as they include a blasting tool, for example a tool for the working of ship hulls, especially the working of welded seams, can also be used for the removal of varnish or paint and other layers or pollutants or contaminants from aircraft. The provision of two outlet drains arranged offset from one another by 90° guarantees reliable discharge of the waste materials arising from the working of the surface, both in the case of side blasting jets and also in the case of overhead blasting jets.

Side blasting operations, in which the surface to be worked forms an angle of, for example, 90° to 45° with the ground surface of the device, are executed essentially by in and out displacement of the overhang beam and by control of the rotary movement of the overhead beam in relation to the upper carrying chassis. Generally, the movements are powered hydraulically or else electrically. An overhead blasting, during which the surface to be worked includes an angle of, for example, 45° to 0° with the ground surface of the device, is essentially carried out by means of in and out displacement of the overhang beam and by control of the rotary movement of the upper carrying chassis in relation to-the substructure, generally likewise powered hydraulically or electrically. With both types of blasting applications, the means for providing the contact and engagement force guarantee the follow-up or resetting of the working means, while also attaining the spacing or distance modifications.

With the method for the operation of a device according to the present invention, the working means are first of all set up to contact and be engaged on the surface to be worked, then are displaced along the surface along a predeterminable path on the surface. The modifications of distances between the working means and the surface arising during the displacement along the path are compensated by the means for providing the contact and engagement force. The movement along the predeterminable path generally occurs by in and out displacement of the overhang beam and by rotation of said overhang beam around a second horizontal axis in relation to the upper carrying chassis, or else by rotation of the upper carrying chassis around a second vertical axis in relation to the substructure. These displacements are controlled, for example, by a stored-programmable control, whereupon automatized paths can be covered as desired. For example, meandering paths are offset one from the other and running essentially vertically. Overlapping paths are used for the clearing off and cleaning of an extended surface, for example a ship's hull. The stored-programmable digital control does not undertake a direct control function for the contact of the working means on the surface to be worked. This is accomplished by the suspension of the working means, especially in connection with the accumulator of the means for providing the contact and engagement force. Even in the case of a curved surface, a continuous, consistent contact of the working means is guaranteed, without the necessity of knowing the precise shape of the curved surface beforehand, and especially without the necessity of describing the curved surface mathematically beforehand. The contact and engagement force is preferably provided by a pneumatic cylinder. As soon as the pneumatic cylinder reaches one end of its displacement path, and a corresponding terminal switch is operated, or a continuous position monitoring arrangement signals that the end position has been reached, the means for supplying a contact and engagement force are reset by means of the first and/or second driving means.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
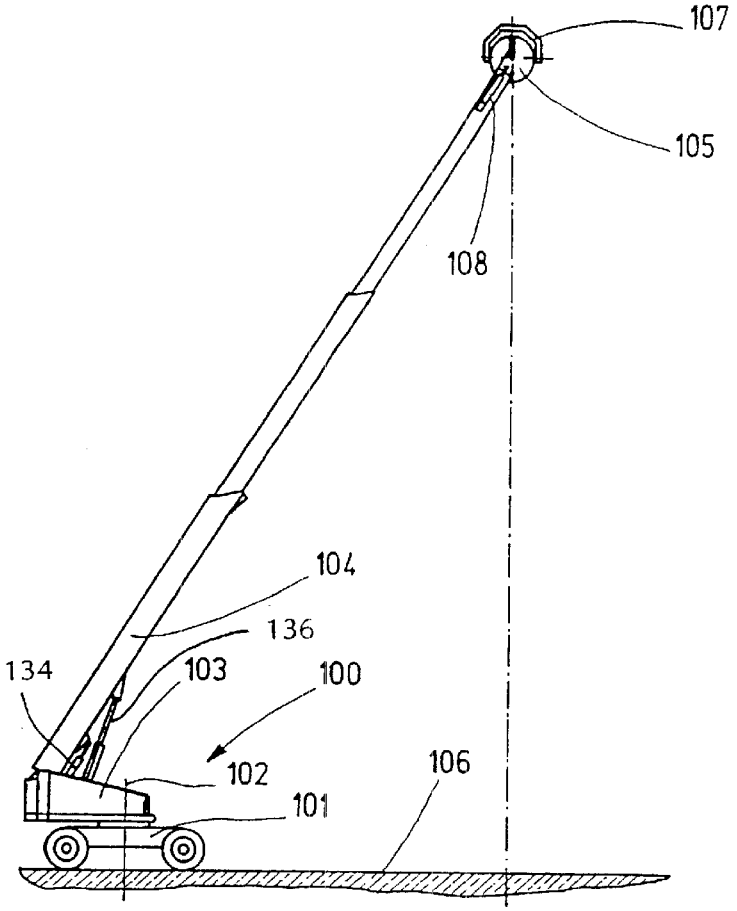
FIG. 1 is a side elevational view of lifting platform with blasting jet basket or cage with blasting jets working to the side according to an embodiment of the present invention.

FIG. 1 illustrates a lifting platform 100 with a blasting jet basket or cage having side blasting jets. Platform 100 includes a motor-powered undercarriage 101 and a rotatable upper carrying chassis 103 rotating thereon around a second perpendicular axis 102. On upper carrying chassis 103, an overhang beam 104 is arranged and is pivotal around a second horizontal axis. Among other things, a hydraulic drive element 136 of the second driving means operates between upper carrying chassis 103 and overhang beam 104. Overhang beam 104 is telescopically extensible, and at its end more distant or remote from upper carrying chassis 103 carries a blasting jet basket or cage 105. The fork 107 of the suspension system of the blasting jet basket or cage 105 is also represented, as well as a third hydraulic drive element 108 of the first driving means. Third hydraulic drive element 108 for the resetting of the means 318 to supply the contact and engagement force and for providing a pivot movement of blasting jet basket or cage 105 around another horizontal axis 333. The side blasting arrangement illustrated can, for example, be undertaken on surfaces to be worked which form an angle of between 45° and 90° with the ground surface 106 of lifting platform 100.

Overhang beam 104 can be rotated relative to upper carrying chassis 103 by means of a first drive element of the second driving means in the form of a hydraulic cylinder 136. This rotary or pivot displacement also operates on cylinder 134, which preferably can serve as transmitter cylinder for the third hydraulic drive element 108. Element 108 in this case serves primarily as a receiving or detection cylinder—hereinafter to be referred to solely as detection—and only secondarily as an independent third hydraulic drive element.

Figure 2:
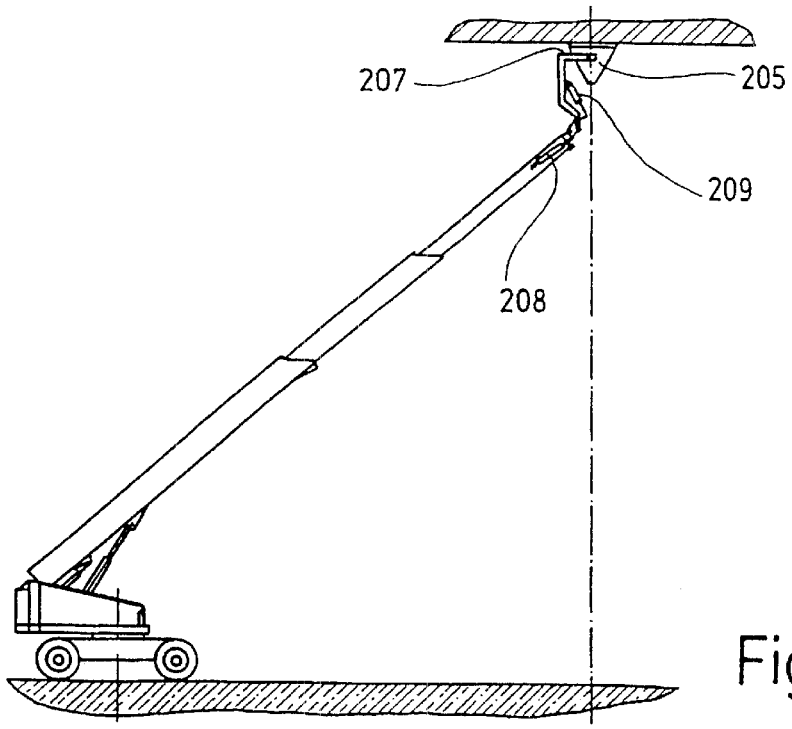
FIG. 2 is a side elevational views of the lifting platform of FIG. 1 with blasting jet basket or cage with blasting jets working overhead.

FIG. 2 shows a lifting platform 100 with a blasting jet basket or cage 205 arranged for the overhead blasting procedure. In addition to the conical blasting jet basket or cage 205, the fork 207 of the suspension arrangement seen in side view and the third drive element 208, a second hydraulic drive element 209 of the first driving means is illustrated. As the third drive element 208, second drive element 209 can serve both for pivot movement of the blasting basket or cage 205, this time around a first horizontal axis 326, and also for resetting of the means 318 for supplying the contact and engagement force. Both drive elements 208 and 209 are embodied as double-action hydraulic cylinders. Alternatively to this embodiment, the use of double-acting pneumatic cylinders can also be considered. The overhead blasting arrangement is provided for use, for example, when the surface 311 to be worked forms an angle of 0° to 45° with the ground surface 106 of lifting platform 100.

The blasting jet basket or cage 105 or 205, opened toward conical surface 311 to be worked as shown in FIGS. 1 and 2, typically has a diameter of 1 m and a mass or bulk weight of 100 kg. The entire device arranged on the end of overhang beam 104 carrying the working means has a mass or bulk weight of approximately 500 kg. Sand, corundum or aluminum oxide, or steel shot serve as possible blasting materials. One possible use for this particular blasting jet basket or cage is the pretreatment of ships' hulls before painting or varnishing.

Figure 3:
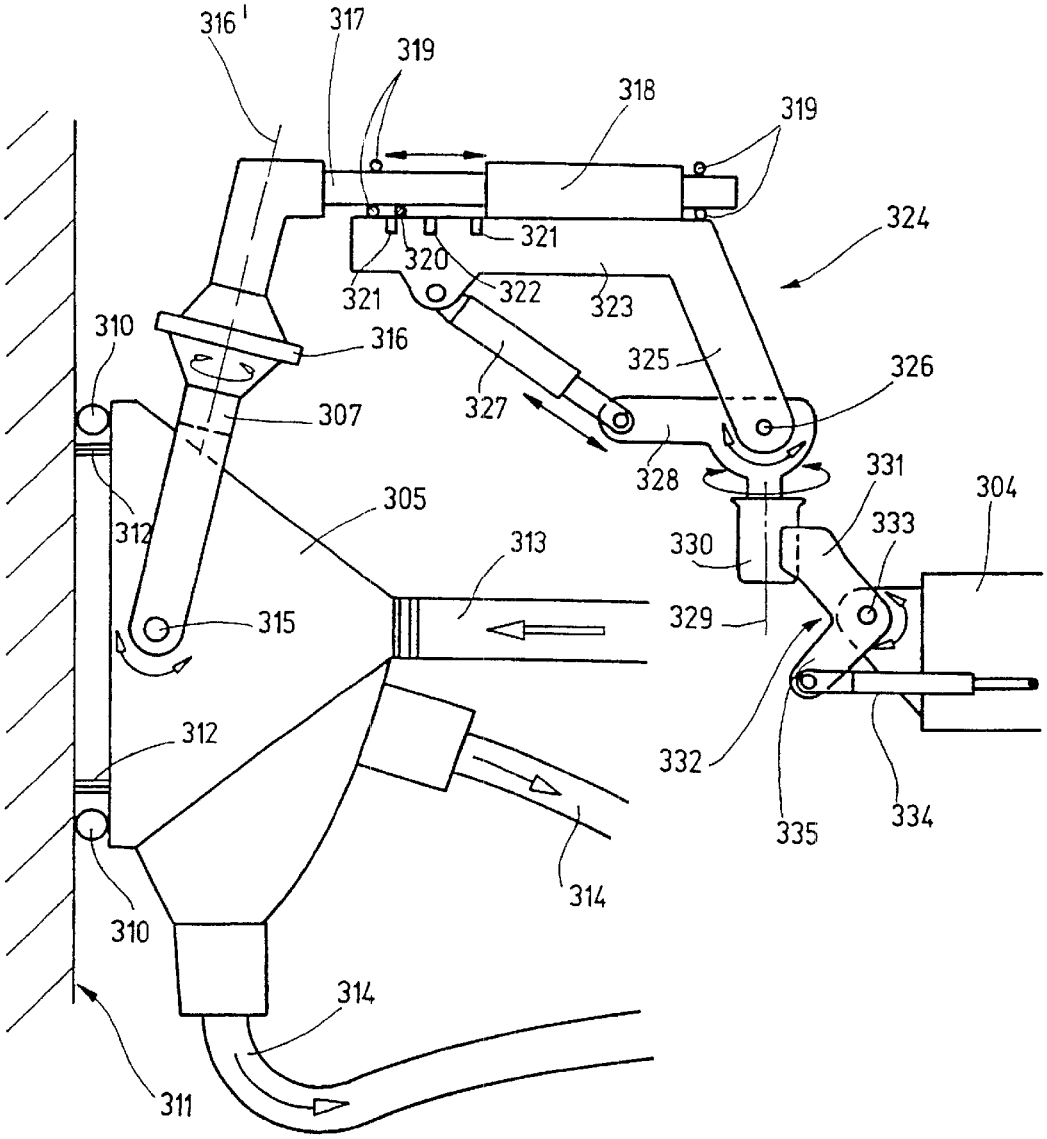
FIG. 3 is a side elevational view of the blasting jet basket or cage with side blasting jets of FIG. 1.

FIG. 3 shows the blasting jet basket or cage 305 during side blasting applications. It engages by means of first rollers 310 on the surface 311 to be worked. A peripheral, multiple-row brush seal 312 provides that the blasting is executed within a closed space, and especially that neither blasting material nor waste products from the blasting treatment penetrate to the outside environment. The blasting jet basket or cage 305 has a feed pipe 313 to feed in the blasting material, as well as two discharge drains 314 mounted offset from one another by approximately 90° on the blasting jet basket or cage 305. Blasting jet basket or cage 305 is suspended to pivot freely and universally around a first horizontal axis 315 on fork 307. The shaft of fork 307 is suspended to pivot freely and universally on a tapered or conical roller bearing 316 around an almost vertical axis 316'. Fork 307 and tapered or conical roller bearing 316 together suspend the blasting jet basket or cage 305 so as to be universally, freely movable around two angularly oriented axes, preferably forming a right angle at the end of overhang beam 304 carrying the blasting jet basket or cage.

Tapered or conical roller bearing 316 is connected through an angle element with the piston 317 of pneumatic cylinder 318. Piston 317 or the piston rod of pneumatic cylinder 318 is supported on second rollers 319. In addition, a cam 320 is mounted on piston 317, where it operates one of the terminal switches 321 or the middle switch 322. The switches are mounted on the first segment 323 of the first arm 324. Pneumatic cylinder 318 is connected securely with or fixed to this first segment 323. First arm 324 is pivoted at a second arm segment 325 around a first horizontal axis 326 in relation to a second arm 328. The pivotal movement is caused by a first double-acting pneumatic or hydraulic cylinder 327 of the first driving means, connected with first arm segment 323 of first arm 324 and second arm 328.

The second arm 328 is pivoted about a first vertical axis 329 by means of a hydraulic rotary motor or pivot cylinder 330. Hydraulic pivot cylinder 330 is connected tightly with or fixed a first arm segment 331 of a two-armed lever 332. Lever 322 can pivot around another horizontal axis 333 related to the end of overhang beam 304 adjacent to the blasting jet basket or cage. The pivot movement is actuated by a second double-acting pneumatic or hydraulic cylinder 334 of the first driving means. One end of cylinder 334 is connected with overhang beam 304. The other end of cylinder 334 is connected with the second arm segment 335 of lever 332. This second double-acting cylinder 334, in the hydraulic embodiment, can be moved in addition or alone also as detection cylinder, being moved by the transmitter cylinder 134 interconnected mechanically parallel. Cylinder 134 is on one end with overhang beam 304 and on the other end with upper carrying chassis 103 and drive element 136. In this manner, even with the pivoting of overhang beam 304 relative to upper carrying chassis 103 around its second horizontal axis, the first vertical axis 329 essentially retains its vertical alignment.

The exemplary embodiment shown in FIG. 3 incorporates a redundancy from the point of view of the pivot movements. This is demonstrated, for example, in that the pivot movement of first arm 324 around the first horizontal axis 326 can be produced both by the first double-acting cylinder 327 and by the second double-acting cylinder 334. This redundancy with regard to the pivot movements allows for a greater degree of independence with the resetting of the blasting jet basket or cage on the surface to be worked.

If a problem, with the spacing or distance modifications between overhang beam 304 and surface 311 to be worked arises, these distances are compensated by the pneumatic cylinder 318, which can be acted upon through a pressure regulation valve (not shown) with its adjustable, continuous air pressure. The compensation of the spacing or distance modification is performed by actuation of pneumatic cylinder 318 until cam 320 cooperates with one of the terminal switches 321. A correspondingly generated control signal actuates one of the double-acting cylinders 327 or 334, or actuates a resetting movement by the in and out displacement of overhang beam 101, through a rotary movement of overhang beam 101 in relation to upper carrying chassis 103 or through a rotary displacement of upper carrying chassis 103 in relation to undercarriage 101. The resetting can thus occur until cam 320 cooperates either with terminal switch 321 at the opposite end of the lift of pneumatic cylinder 318 or with middle switch 322.

In an analogous manner, by mounting of terminal switches or angle position detectors or angle transmitters on the two axes 315 and 316' of the suspension, the blasting jet basket or cage 305, when a predeterminable pivot angle of blasting basket or cage 305 to the fork 307 (or to the axis 316' of tapered or conical roller bearing 316) has been attained by means of pivot cylinder 330, double-acting cylinders 327 and 334 or telescopic overhang beam displacement, then the rotary movement of overhang beam 101 in relation to upper carrying chassis 103 or the rotary movement of upper carrying chassis 103 in relation to the undercarriage 101 are again brought into a zero setting or starting position.

Figure 4:
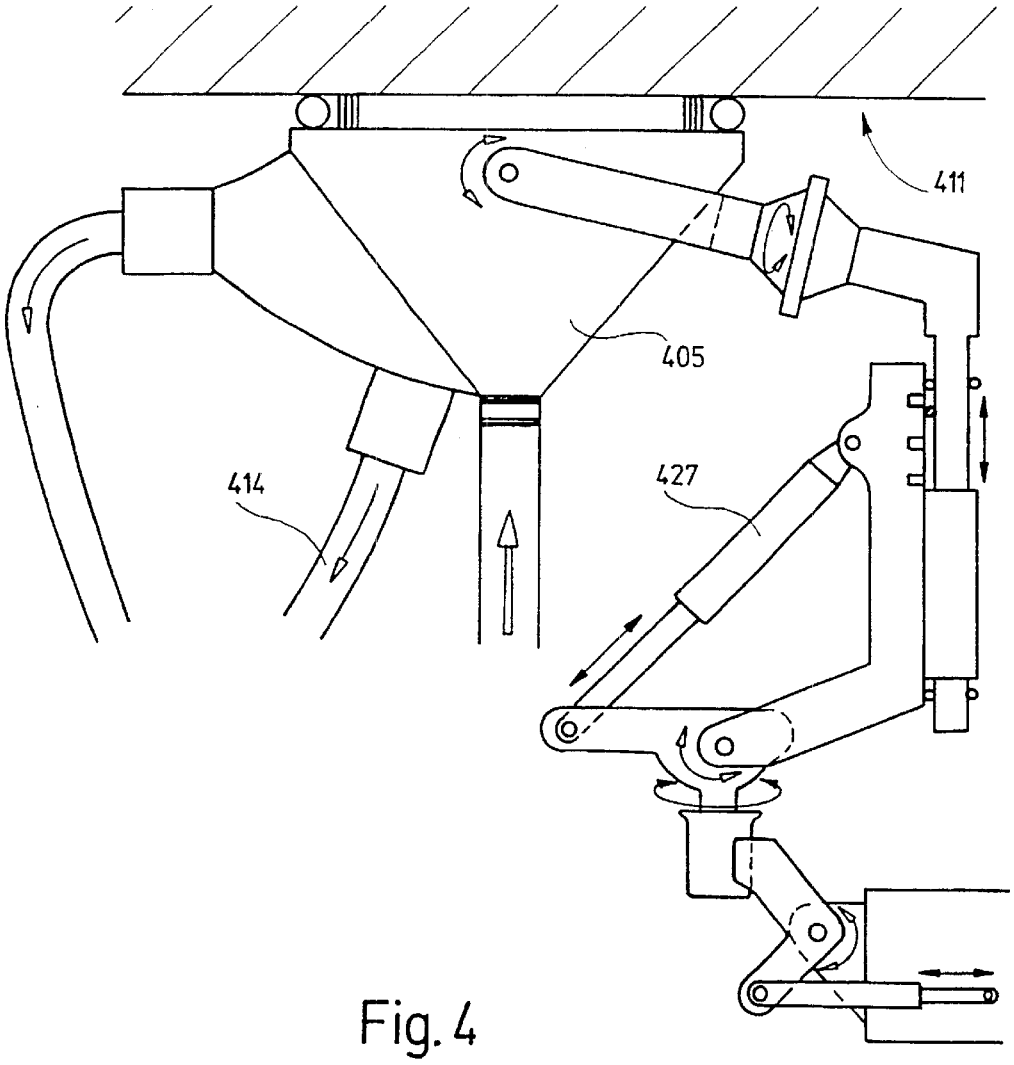
FIG. 4 is a side elevational view of the blasting jet basket or cage with overhead blasting jet of FIG. 2.

FIG. 4 shows the blasting jet basket or cage 405 during overhead application of blasting jets. The quite remarkable difference as compared with the manner of operation of FIG. 3 resides in the displacement of the first double-acting cylinder 427. Also, with the overhead blasting application, the waste materials arising as a result of the processing are discharged from blasting jet basket or cage 405 essentially through the discharge drain 414. The other features of the operation, particularly the compensation and equalization of distance modifications between blasting jet basket or cage 405 and the surface 411 to be worked, occur in an analogous manner to the manner of operation as is described for FIG. 3. During the process, with the overhead blasting application as compared with the side blasting application, an increased force coming from the weight portion of the means must be applied to the allocation of the contact and engagement force. This portion can, for example, be determined with the aid of a certain acceleration detector mounted on pneumatic cylinder 318 and determining the ground acceleration, or be determined by an angle transmitter which determines the angle setting of first arm 324 in relation to first horizontal axis 326.

Figure 5:
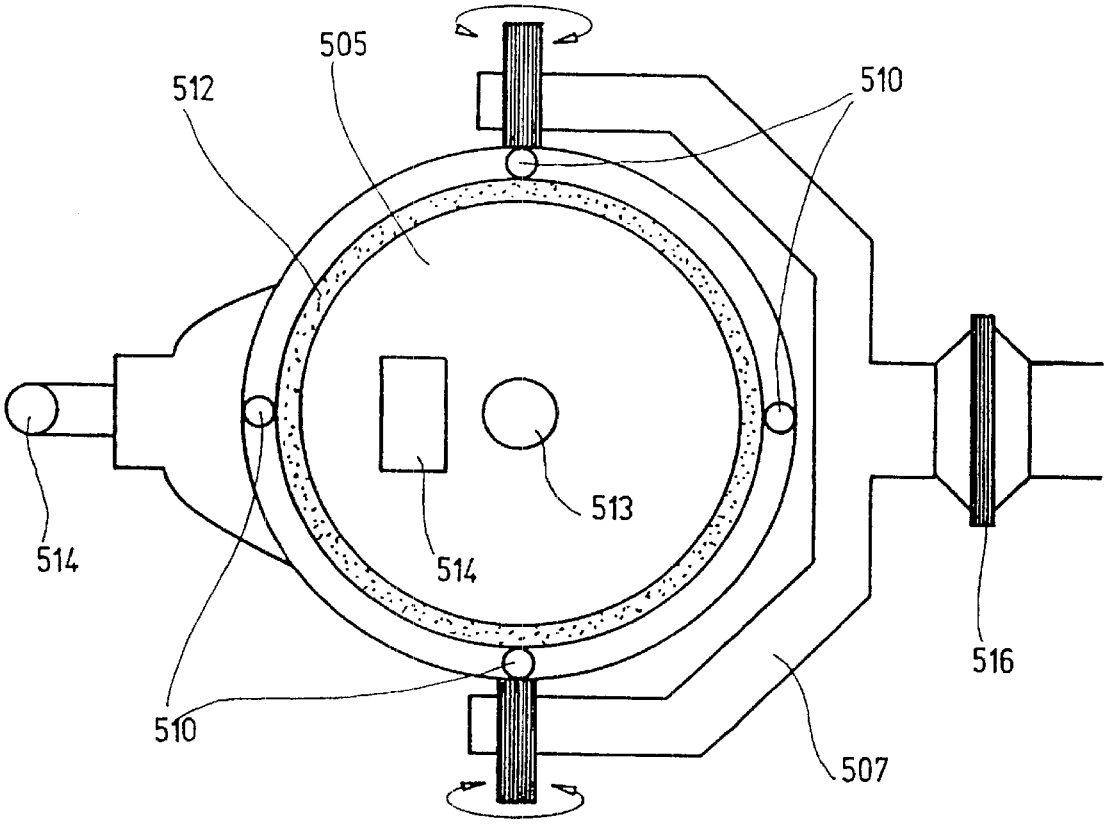
FIG. 5 is a plan view of the blasting jet basket or cage with overhead blasting jets viewed from the surface to be worked.

FIG. 5 shows the view of blasting jet basket or cage 505 during overhead blasting application as viewed from the surface 411 to be worked. The suspension of blasting jet basket or cage 505 by means of fork 507 and the tapered or conical roller bearing 516 are represented. Rollers 510 guarantee a low-friction guiding of blasting jet basket or cage 505 on surface 411 to be worked. The annular, multiple-row brush seal 512 provides a reliable sealing of the blasting area, sealing it off from the environment. Through the feed pipe 513 the blasting material is fed. Through discharge drain 514, the material arising from the working of blasting jet basket or cage 505 is discharged.

While an embodiment has been chosen to illustrate the invention, it will be understood by those skilled in the art that various changes and modifications can be made therein without departing from the scope of the invention as defined in the appended claims.

What is claimed is:

1. A lifting device for treating a work surface comprising:

a support;

a working means for engaging the work surface and mounted on said support;

pressure means, arranged between said support and said working means, for providing a contact and engagement force on said working means; and a suspension suspending said working means to move freely about two angularly oriented axes, said pressure means engaging said suspension.

2. A lifting device according to claim 1 wherein said support is an overhang beam.

3. A lifting service according to claim 1 wherein said support is a platform.

4. A lifting device according to claim 1 wherein said axes are substantial perpendicular.

5. A lifting device according to claim 1 wherein said pressure means comprises an accumulator acted upon by continuous and adjustable pressure and movable along a lifting path; and a detector arranged along said lifting path for detection of lift positions of said accumulator.

6. A lifting device according to claim 5 wherein said accumulator is a pneumatic cylinder.

7. A lifting device according to claim 5 wherein said accumulator is a hydraulic cylinder.

8. A lifting device according to claim 5 wherein said pressure means is adjusted by a pressure regulation valve.

9. A lifting device according to claim 5 wherein said detector comprises at least one position switch.

10. A lifting device according to claim 5 wherein said suspension is rotated relative to said support about a first vertical axis and a first horizontal axis by a first drive means, said first drive means being one of pneumatic, hydraulic and electrical; and at least one part of said first drive means is controlled by said detector.

11. A lifting device according to claim 10 wherein said support is a telescopically displaceable overhang beam, said beam being movable by one of pneumatic, hydraulic and electrical second drive means relative to one of an upper carrying chassis about a about a second horizontal axis;

said upper carrying chassis is displaceable relative to a substructure by rotation about a second vertical axis; and at least a part of said second drive means is controlled by said detector.

12. A lifting device according to claim 5 wherein said support is a telescopically displaceable overhang beam, said beam being movable by one of pneumatic, hydraulic and electrical second drive means relative to one of an upper carrying chassis about a about a second horizontal axis;

said upper carrying chassis is displaceable relative to a substructure by rotation about a second vertical axis; and at least a part of said second drive means is controlled by said detector.

13. A lifting device according to claim 5 wherein said working means compress a working cage.

14. A lifting device according to claim 13 wherein said cage houses a blasting jet tool for cleaning surfaces.

15. A lifting device according to claim 13 wherein said case comprises a feed pipe for supplying a blasting jet medium and two discharge drains offset from one another by approximately 90°.

16. A method of operating a lifting device, comprising the steps of:

contacting and engaging a working means on a surface to be treated by a pressure means arranged between the working means and a support on which the working means is mounted;

displacing said working means along a predetermined path; and compensating for modifications of distances between the working means and the surface to be treated resulting from displacement of the working means along the predetermined path by a suspension engaging the pressure means and suspending the working means to move freely about two angularly oriented axes.

17. A method according to claim 16 wherein the pressure means is reset by first and second drive means in response to control information from a detector of lift positions of the pressure means.

18. A method according to claim 17 wherein a first position switch at a first lift end of the pressure means is operated until a second position switch on an opposite lift end of the pressure means is operated.

19. A method according to claim 18 wherein displacement of the working means is controlled along the predetermined path by in and out displacement of an overhang beam forming the support and by one of movement of an upper carrying chassis supporting the overhang beam relative a substructure about a second vertical axis and movement of the overhang beam relative to the upper carrying chassis about a second horizontal axis, the displacement of the working means being controlled by a stored-programmable control drive; and the pressure means is reset by one of movement of the overhang beam relative to the upper carrying chassis about a second horizontal axis and movement of the upper carrying chassis relative to the substructure about the second vertical axis.

20. A method according to claim 19 wherein resetting displacement forms an input variable for controlling displacement of the working means along the predeterminable path.

* * * * *